US006458001B1

(12) United States Patent
Chen et al.

(10) Patent No.: US 6,458,001 B1
(45) Date of Patent: Oct. 1, 2002

(54) RECEPTACLE CONNECTOR HAVING ANTI-MISMATING STRUCTURES

(75) Inventors: Qiang Chen; GuangXing Shi; LiHua Cheng, all of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/027,756

(22) Filed: Dec. 19, 2001

(51) Int. Cl.[7] ..... H01R 13/64
(52) U.S. Cl. ..... 439/680; 439/676; 439/677
(58) Field of Search ..... 439/680, 676, 439/677, 607

(56) References Cited

U.S. PATENT DOCUMENTS 6,257,935 B1 * 7/2001 Zhang et al. ..... 439/680
6,312,293 B1 * 11/2001 Wang ..... 439/677
6,350,156 B1 * 2/2002 Hasircoglu et al. ..... 439/677

* cited by examiner

*Primary Examiner*—Tho D. Ta
(74) *Attorney, Agent, or Firm*—Wei Te Chung

(57) ABSTRACT

A receptacle connector (1; 1') includes an insulative housing (2; 2'), a contact module (3; 3'), a conductive outer shield (4; 4') and a pair of blocking tabs (441; 441'). The insulative housing defines a receiving cavity (28; 28'), a slot (203; 203') communicating with the receiving cavity, and a groove (202; 202') in communication with both the receiving cavity and the slot. The contact module has an insulative portion (30; 30') assembled in the insulative housing and a number of electrical contacts (32; 32') retained to the insulative portion and partly extending into the receiving cavity. Each blocking tab has a curved portion (443; 443') resiliently received in the slot and a finger (445; 445') extending through the groove into the receiving cavity to prevent an incorrect insertion of a non-complementary plug connector (6).

3 Claims, 8 Drawing Sheets

RECEPTACLE CONNECTOR HAVING ANTI-MISMATING STRUCTURES

BACKGROUND OF THE INVENTION

1. Field of the Invention

The present invention relates to an electrical connector, and particularly to a receptacle connector having anti-mismating structures for preventing incorrect insertion of a non-complementary plug connector.

2. Description of the Related Art

Both RJ-45 connector assemblies and RJ-11 connector assemblies are generally used in signal transmission networks. Each of the RJ-45 connector assembly and the RJ-11 connector assembly includes a plug connector and a corresponding receptacle connector. When mating, the plug connector is inserted into the corresponding receptacle connector. However, the main difference between an RJ-45 plug connector and an RJ-11 plug connector, or between an RJ-45 receptacle connector and an RJ-11 receptacle connector, is that the dimensions of the RJ-45 plug connector and the RJ-45 receptacle connector are larger than those of the respective RJ-11 plug connector and RJ-11 receptacle connector. Thus, an RJ-11 plug connector may be mistakenly inserted into an RJ-45 receptacle connector, which may result in damages of both the RJ-11 plug connector and the RJ-45 receptacle connector.

Various designs have been previously proposed to solve the above problems, including providing a separate element accommodated in a receiving cavity of an insulative housing of the RJ-45 receptacle connector to block an incorrectly plugged RJ-11 plug connector. However, the RJ-45 receptacle connector with the separate element has the shortcoming of complicated structures of the insulative housing and complicated assembling procedures of the receptacle connector, and increases in dimension. U.S. Pat. Nos. 6,257,935, 6,312,293 and 6,319,070 of the same assignee with the instant application, disclose some approaches.

Therefore, an improved receptacle connector is desired to overcome the above-mentioned disadvantages.

SUMMARY OF THE INVENTION

A major object of the present invention is to provide a structure-simplified receptacle connector which incorporates anti-mismating structures without enlarging its overall dimension.

A receptacle connector in accordance with the present invention comprises an insulative housing, a contact module, a conductive outer shield and a pair of blocking tabs. The insulative housing defines a receiving cavity, a slot in communication with the receiving cavity and a groove communicating with both the receiving cavity and the slot. The contact module comprises an insulative portion assembled in the insulative housing and a plurality of electrical contacts retained to the insulative portion and partly extending into the receiving cavity. The conductive outer shield substantially encloses the insulative housing. Each blocking tab comprises a curved portion resiliently extending in the slot and a finger extending from the curved portion though the groove into the receiving cavity to prevent an incorrect insertion of a non-complementary plug connector.

Other objects, advantages and novel features of the invention will become more apparent from the following detailed description of the present embodiment when taken in conjunction with the accompanying drawings.

DETAILED DESCRIPTION OF THE INVENTION

Figure 1:
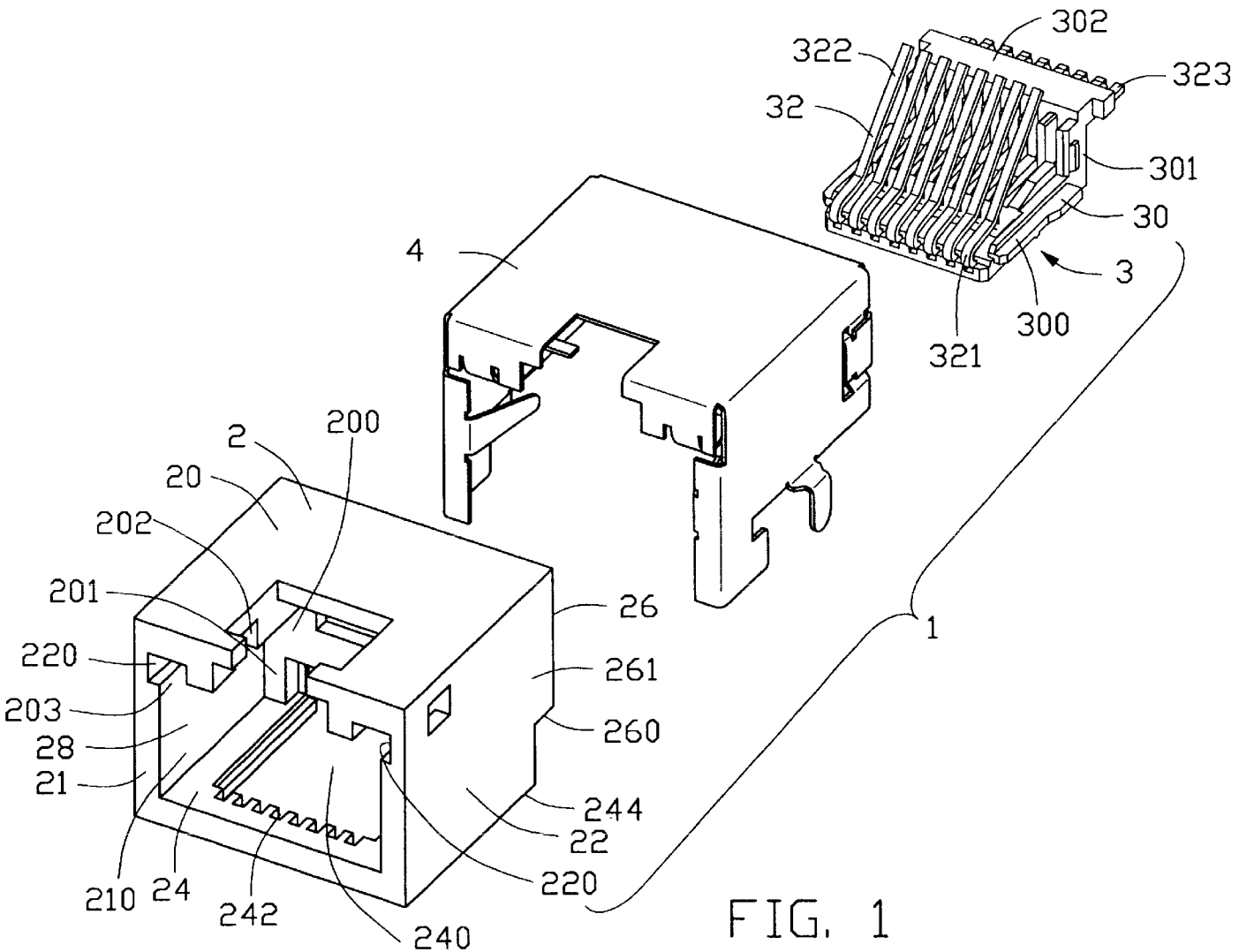
FIG. 1 is an exploded view of a receptacle connector in accordance with a first embodiment of the present invention.

It will be noted here that for a better understanding, most of like components are designated by like reference numerals through various figures in the embodiments.

Referring to FIG. 1, a receptacle connector 1 in accordance with a first embodiment of the present invention comprises an insulative housing 2, a contact module 3 and a conductive outer shield 4.

The insulative housing 2 comprises a top wall 20, a pair of opposite side walls 22 perpendicularly connected with the top wall 20, a bottom wall 24 opposite to the top wall 20, and a rear wall 26 connecting with the top, the bottom, and the side walls 20, 24, 22. The top, the side, the bottom, and the rear walls 20, 22, 24, 26 confine a receiving cavity 28 therebetween. The insulative housing 2 defines a front face 21 having an opening 210 corresponding to the receiving cavity 28.

The top wall 20 defines a rectangular opening 200 adjacent to a front portion thereof and in communication with the receiving cavity 28, a channel 201 opening a center front section of the opening 200 forwardly, a pair of grooves 202 recessed from a bottom face of two opposite sides thereof and extending in a direction perpendicular to an insertion direction along which a complementary plug connector 5 (FIG. 7) is inserted into the receiving cavity 28, and a pair of slots 203 extending in directions parallel to the insertion direction to be respectively adjacent to the side walls 22 and to intersect with the grooves 202, respectively. The grooves 202 communicate with both the opening 201 and the receiving cavity 28. The slots 203 communicate with both the grooves 202 and the receiving cavity 28.

Each side wall 22 defines a recess 220 in an inner surface of an upper portion thereof to communicate with the adjacent groove 202, the adjacent slot 203, and the receiving cavity 28. The bottom wall 24 defines a hole 240 in a rear portion thereof and a plurality of passageways 242 opening rearwardly to the hole 240. The rear wall 26 has a step portion 261 defining a bottom face 260 upwardly of a bottom face 244 of the bottom wall 24 such that when the receptacle connector 1 is mounted to a printed circuit board (not shown), the bottom face 260 of the rear wall 26 abuts against a top face of the printed circuit board while the bottom face 244 of the bottom wall 24 located below a bottom face of the printed circuit board.

The contact module 3 comprises an insulative portion 30 and a plurality of electrical contacts 32 retained to the insulative portion 30. The insulative portion 30 comprises a horizontal section 300, a vertical section 301 extending upwardly from a rear section of the horizontal section 300 and a mounting section 302 extending rearwardly from an upper section of the vertical section 301 and being parallel to the horizontal section 300. Each electrical contact 32 comprises a retention portion (not shown) retained to the insulative portion 30 and configured, as known to persons skilled in the pertinent art, corresponding to the construction of the insulative portion 30, a curved portion 321 extending from the retention portion and forwardly beyond a front end of the horizontal section 300 of the insulative portion 30, a contact portion 322 extending upwardly and rearwardly from the curved portion 321, and a mounting portion 323 extending rearwardly beyond a rear end of the mounting section 302 of the insulative portion 30.

Referring also to FIGS. 3–6, the conductive outer shield 4 comprises a top wall 40, a pair of side walls 42 perpendicularly connecting with the top wall 40, a front wall 44 connecting both the top and the side walls 40, 42, and a rear wall 46 opposite to the front wall 44. The top wall 40 comprises a generally rectangular cutout 400 in a front section thereof corresponding to the opening 200 and the channel 201 of the top wall 20 of the insulative housing 2. Each side wall 42 comprises a front portion 420 flush with the front wall 44 with respect to a bottom thereof and a rear portion 422 upwardly offset from the front portion 420 with respect to a bottom thereof. The rear portion 422 of each side wall 42 comprises a grounding tab 423 extending firstly slightly outwardly and then downwardly from the bottom thereof, a cantilevered beam 424 at a rear end thereof and a slit 425 adjacent to the beam 424.

The front wall 44 is formed with a pair of rearwardly extending opposite tabs 440 at two opposite sides thereof and respectively adjacent to the side walls 42. A pair of blocking tabs 441 each comprises a connecting portion 442 integrally extending downwardly from an upper section of the front wall 44, a curved or deflection portion 443 extending rearwardly from the connecting portion 442, and a finger 445 extending from a rear end 444 of the curved portion 443 with two opposite ends thereof extending laterally beyond the width of the curved portion 443.

The rear wall 46 is upwardly of the side and the front walls 42, 44 with respect to a bottom thereof and comprises a pair of extensions 460 extending forwardly from two opposite sides thereof to overlap the beams 424 of the side walls 42, and a pair of latch sections 462 extending respectively from the extensions 460 to be locked in the slits 425 of the side walls 42, thereby providing a retention between the rear and the side walls 46, 42.

Figure 2:
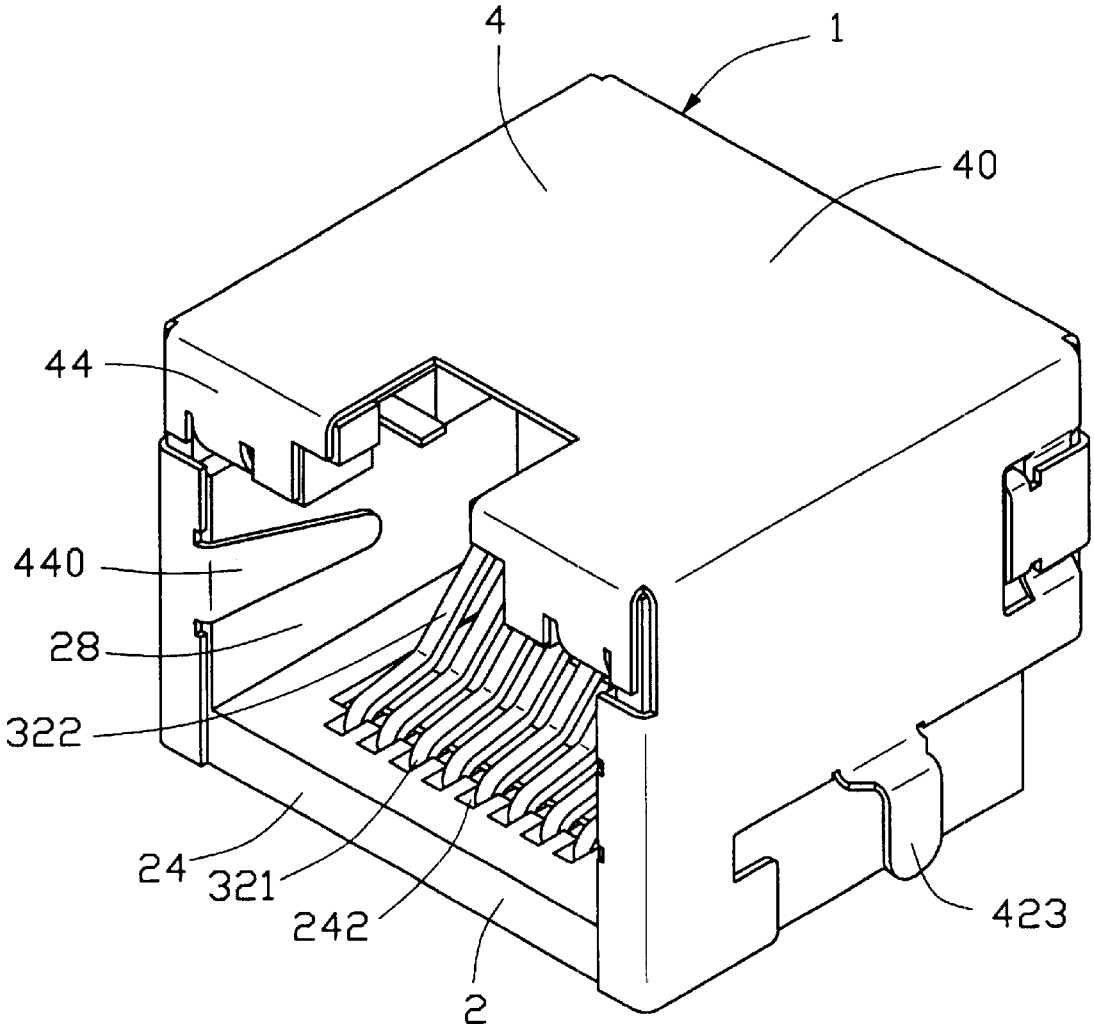
FIG. 2 is an assembled perspective view of the receptacle connector of FIG. 1.
Figure 3:
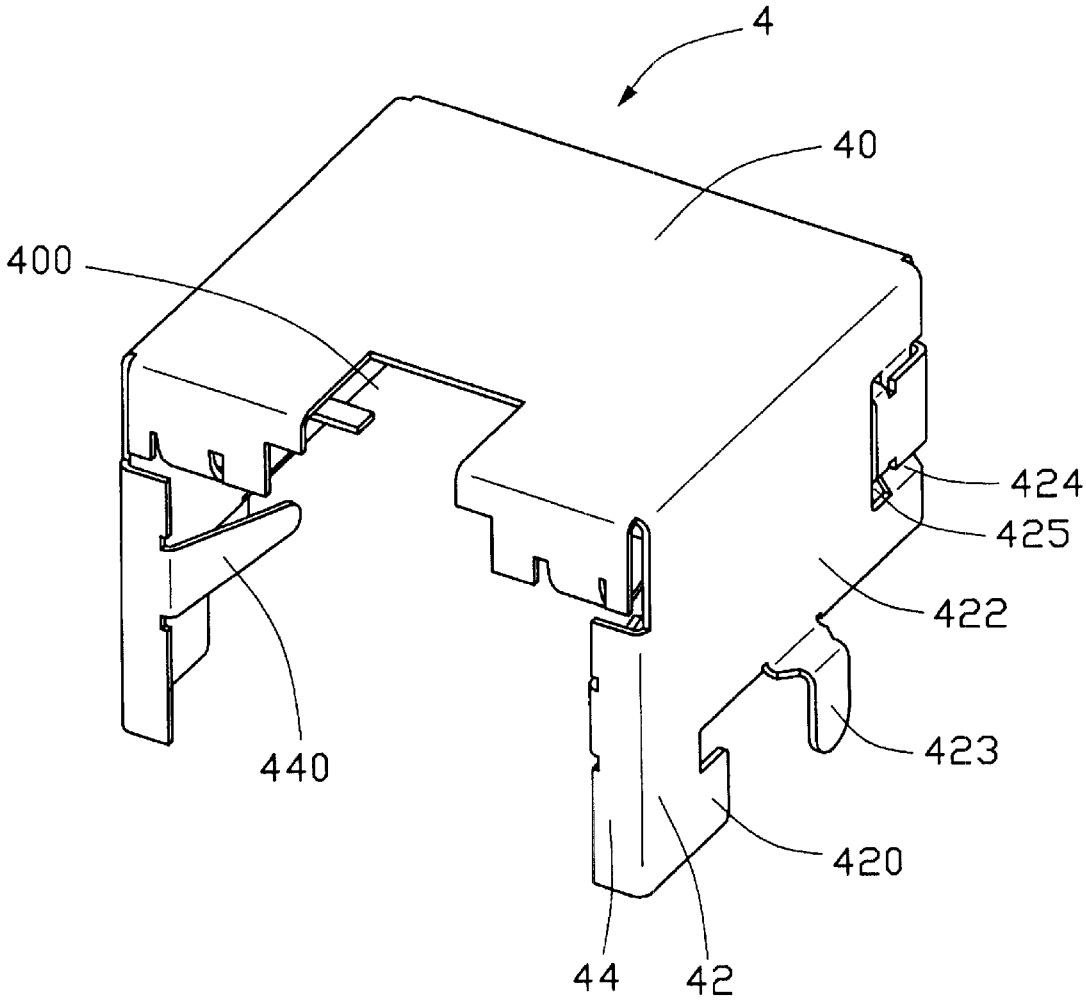
FIG. 3 is a perspective view of a conductive outer shield of the electrical connector of FIG. 1.
Figure 4:
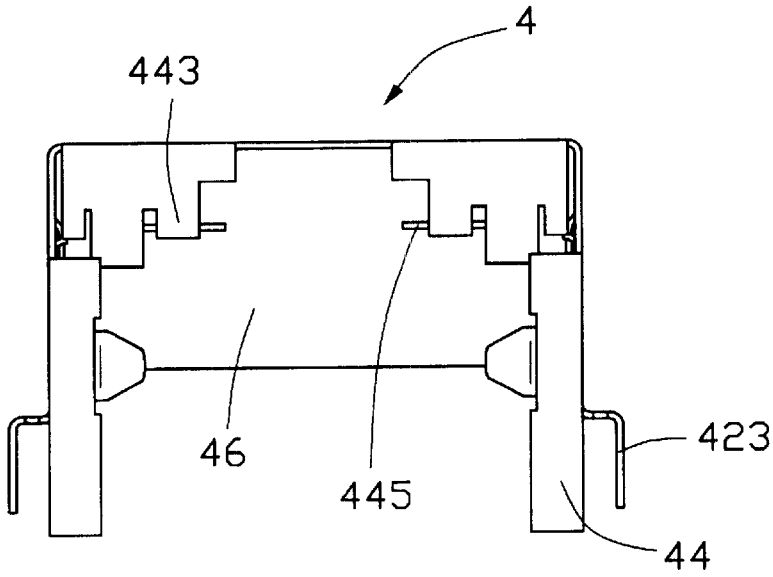
FIG. 4 is a front view of the conductive outer shield of FIG. 3.
Figure 5:
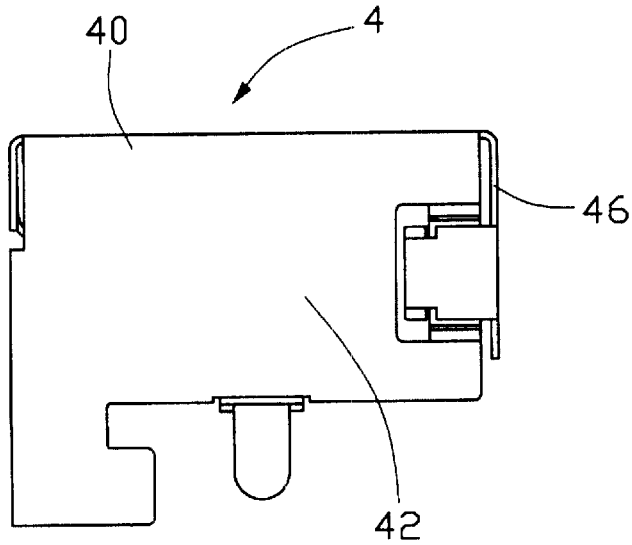
FIG. 5 is a side elevational view of the conductive outer shield of FIG. 3.
Figure 6:
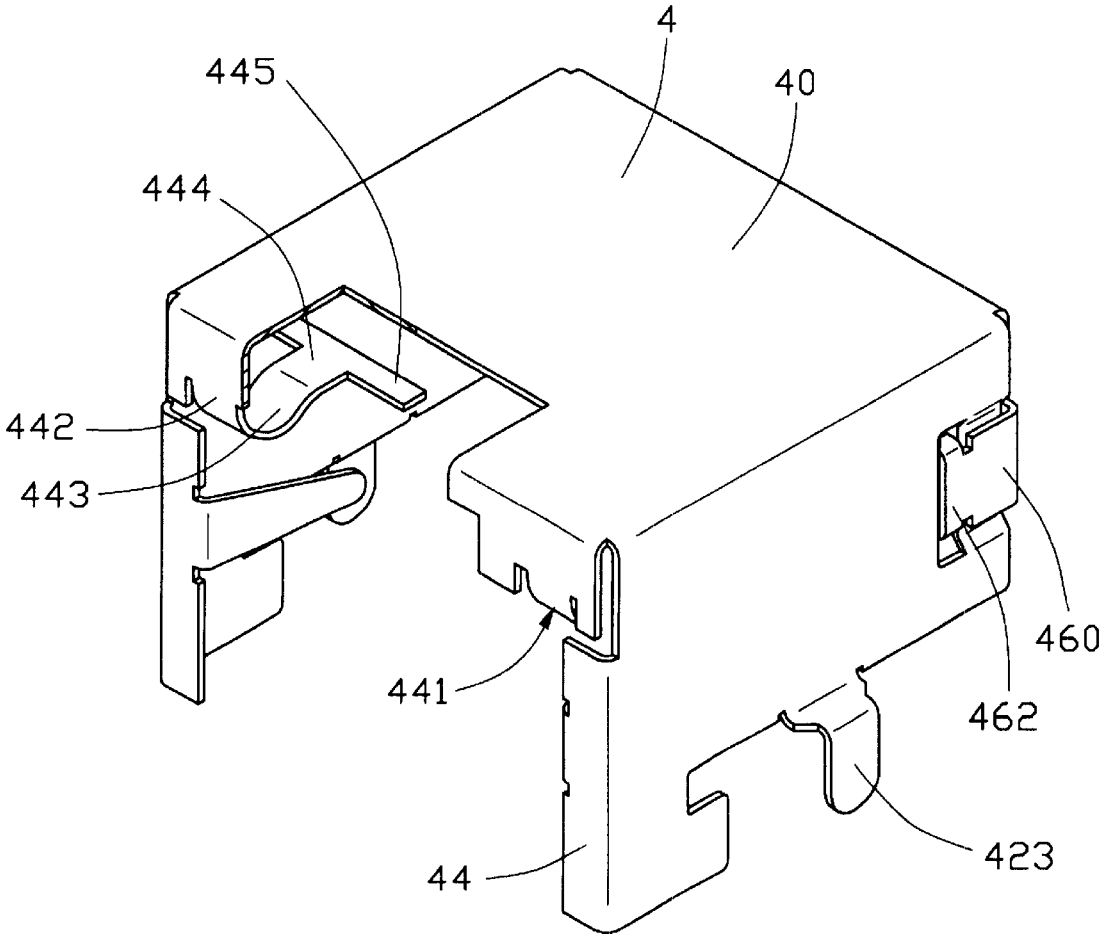
FIG. 6 is a view similar to FIG. 3 but the conductive outer shield being partly cutaway.

Referring also to FIG. 2, in assembly, the horizontal section 300 of the insulative portion 30 of the contact module 3 is received in the hole 240 of the bottom wall 24 of the insulative housing 2 and is reliably secured to the insulative housing 2 in ordinary ways known to persons skilled in the pertinent art. The curved portions 321 of the electrical contacts 32 extend into corresponding passageways 242 of the bottom wall 24 while the contact portions 322 of the electrical contacts 32 extend into the receiving cavity 28. The mounting portions 323 of the electrical contacts 32, as known to persons skilled in the pertinent art, flush with the bottom face 260 of the step portion 261 of the rear wall 26 to be surface mounted to the top face of the printed circuit board, although they can be mounted to the printed circuit board in other means, such as through hole technology, as desired.

The conductive outer shield 4 is then assembled to the insulative housing 2 in ordinary ways known to one of ordinary skill in the pertinent art, so that the top, the side, the front and the rear walls 40, 42, 44, 46 of the conductive outer shield 4 substantially encloses the top wall 20, the side walls 22, the front face 21 and the rear wall 26 of the insulative housing 2. The rearwardly extending tabs 440 extend into the receiving cavity 28 to contact with a conductive outer shield of the complementary plug connector 5. The curved portions 443 of the blocking tabs 441 are resiliently received in the slots 203 while the fingers 445 extend in the grooves 202. One of the opposite ends of each finger 445 extends beyond corresponding groove 202 into the upper narrow portion 281 (FIG. 7) of the receiving cavity 28 where the latch of the complementary plug is adapted to be inserted into, while another of the opposite ends of each finger 445 extends in the recess 220 to be stopped from outwardly moving by the side wall 22.

Figure 7:
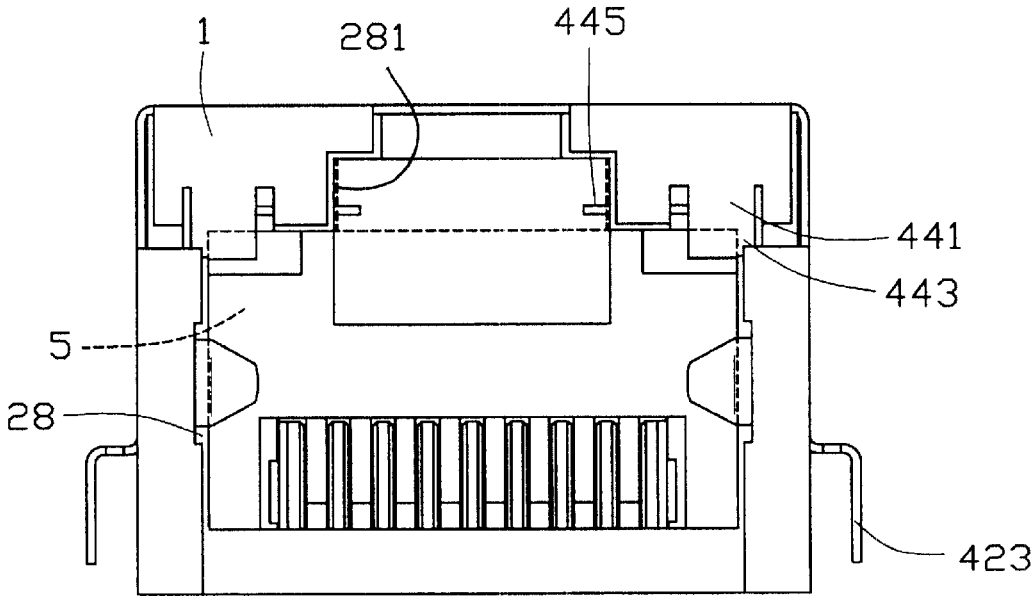
FIG. 7 is a front view of the receptacle connector of FIG. 1 but with a complementary plug connector shown in dotted lines.

Referring also to FIG. 7, in the course of inserting the complementary plug connector 5 into the receiving cavity 28, the curved portions 443 of the blocking tabs 441 are encountered and are pushed in such a way that the fingers 445 extend upwardly to retreat from the receiving cavity 28 to permit the complementary plug connector 5 to completely enter into the receiving cavity 28 of the receptacle connector 1 and establish an electrical connection therebetween.

Figure 8:
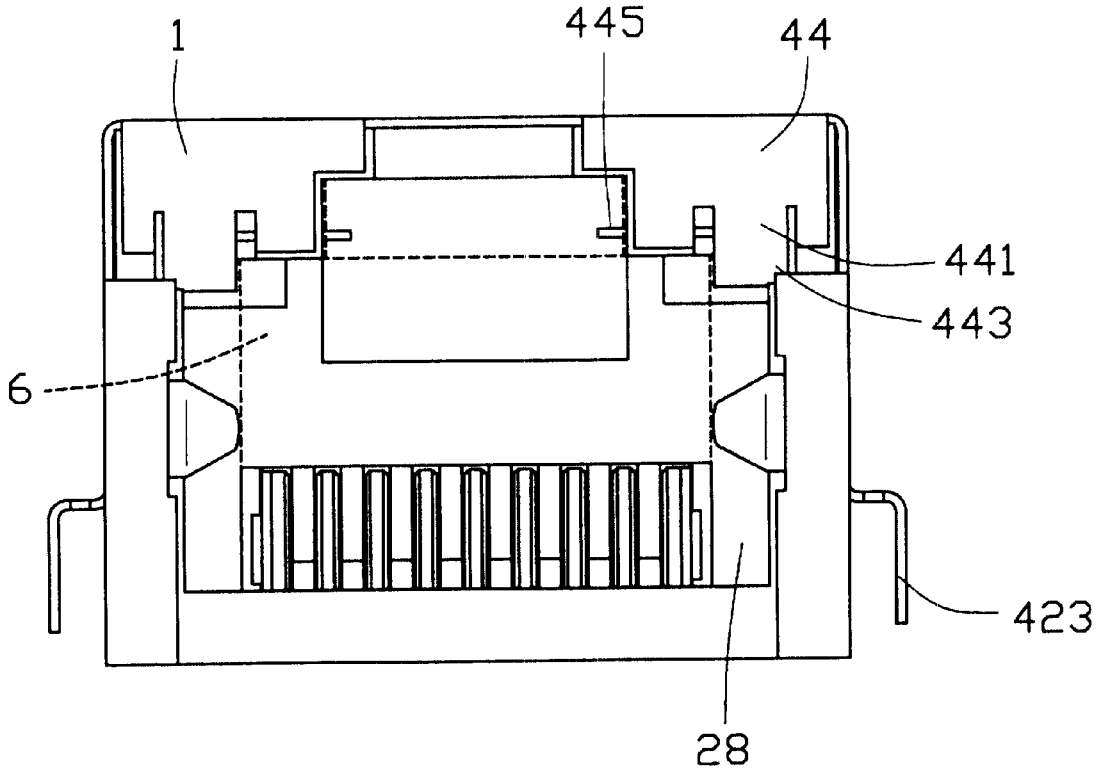
FIG. 8 is a front view of the receptacle connector of FIG. 1 but with a non-complementary plug connector shown in dotted lines.

Referring also to FIG. 8, during the course of incorrectly inserting a non-complementary plug connector 6 into the receiving cavity 28 of the receptacle connector 1, the curved portions 443 of the blocking tabs 441 are not encountered due to the smaller dimension of the non-complementary plug connector 6, so the fingers 445 do not retreat from the receiving cavity 28 and the non-complementary plug connector 6 can not completely enter into the receiving cavity 28 due to the presence of the fingers 445 in the receiving cavity 28.

Figure 9:
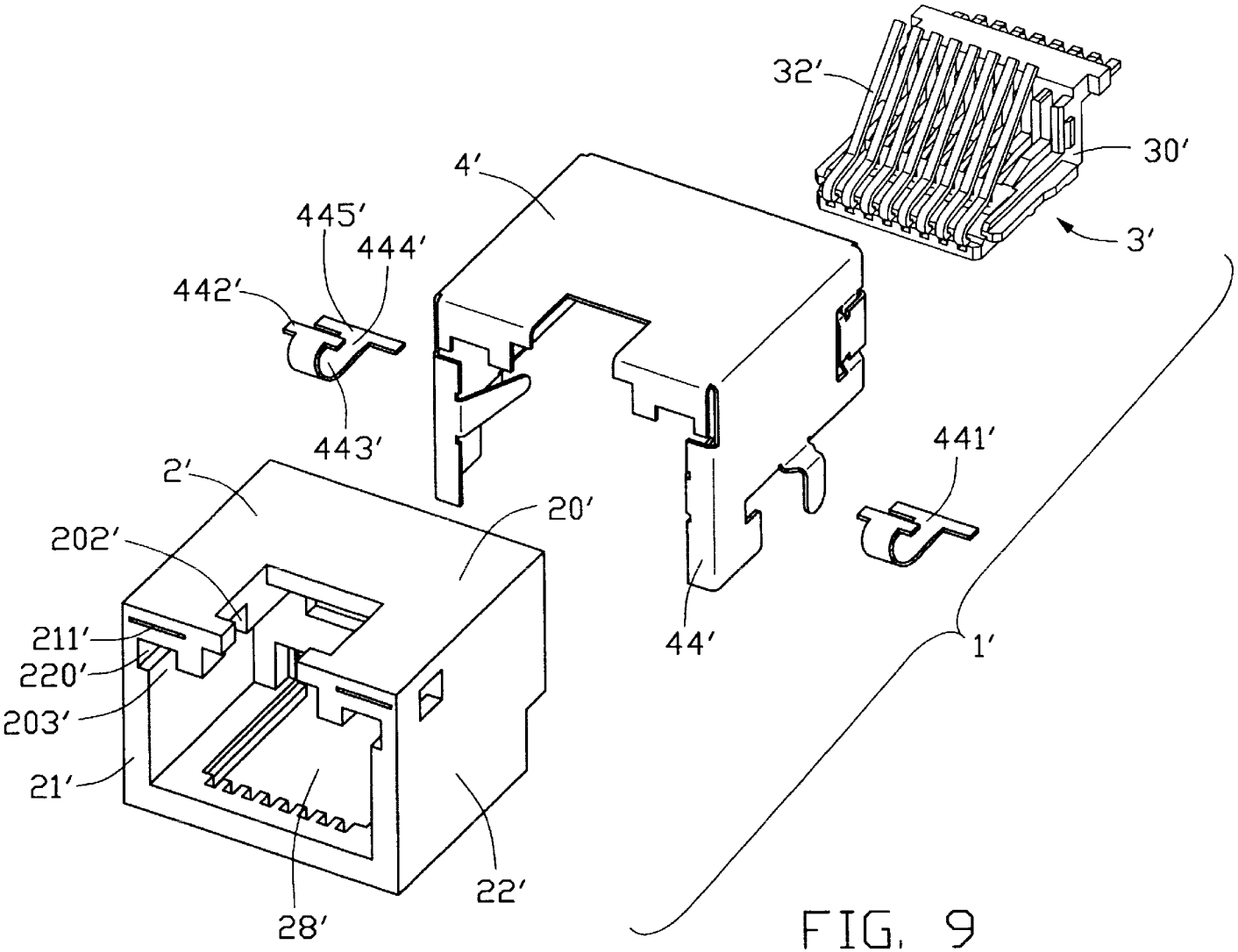
FIG. 9 is an exploded perspective view of a receptacle connector in accordance with a second embodiment of the present invention.

Referring to FIG. 9, a receptacle connector 1' in accordance with a second embodiment of the present invention and similar to the receptacle connector 1 of the first embodiment of the present invention is shown. The receptacle connector 1' comprises an insulative housing 2', a contact module 3', a conductive outer shield 4' and a pair of blocking tabs 441'. The insulative housing 2' is similar to the insulative housing 2 of the first embodiment except that a retention slit 211 ' is defined above each slot 203' of the top wall 20' thereof. The contact module 3' comprises an insulative portion 30' and a plurality of electrical contacts 32' and is similarly constructed with respect to the contact module 3 of the first embodiment, so a detailed description thereof is omitted herein. The conductive outer shield 4' is similar to the conductive outer shield 4 of the first embodiment but without a pair of blocking tabs formed in a front wall 44' thereof.

Each blocking tab 441' comprises a connecting portion 442' received in the retention slit 211 ' and having structures to be retained in the retention slit 211', a curved portion 443' resiliently extending from the connecting portion 442' into the slot 203', and a finger 445' extending from a rear end 444' of the curved portion 443' with two opposite ends thereof extending beyond the width of the curved portion 443' into a recess 220' of a side wall 22' and a groove 202' of the top wall 20', respectively. One of the two opposite ends of each blocking tab 441 extends beyond corresponding groove 202' into a receiving cavity 28' of the insulative housing 2'.

The curved portions 443' and the fingers 445' of the blocking tabs 441' function in the same way as the curved portions 443 and the fingers 445 of the blocking tabs 441 of the first embodiment when a complementary or a non-complementary plug connector 5 or 6 is to be inserted into the receiving cavity 28' of the receptacle connector 1', a detailed description therefor is thus omitted herefrom.

The blocking tabs 441, 441' are made of metallic sheet materials and are thus small in thicknesses thereof to remain the receptacle connector 1, 1' in relatively small dimensions, thereby complying with the miniaturization trend in the present electronic field. The insulative housing 2, 2' is comparatively simple in constructions and the assembling procedure of the receptacle connector 1, 1' is comparatively simplified.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A receptacle connector comprising:

an insulative housing comprising a receiving cavity;

a plurality of electrical contacts being received in the insulative housing and partly extending into the receiving cavity; and a conductive outer shield enclosing the insulative housing and comprising a blocking tab, the blocking tab comprising a resilient curved portion and a finger extending into an upper narrow portion of the receiving cavity, the finger being upwardly movable when the curved portion is pushed;

wherein the insulative housing defines a slot in communication with the receiving cavity and a groove in communication with the receiving cavity and the slot, and the curved portion of the blocking tab is received in the slot while the finger extends through the groove into the receiving cavity;

wherein the insulative housing comprises a top wall defining the slot and the groove, and a side wall connecting with the top wall and defining a recess communicating with the slot and the groove, the finger having an end movably received in the recess;

the conductive outer shield comprises a front wall and the blocking tab comprises a connecting portion extending from the front wall and connecting with the curved portion, wherein the conductive outer shield and the blocking tab are a one-piece construction.

2. The receptacle connector as claimed in claim 1, wherein the slot intersects with the groove.

3. A receptacle connector comprising:

an insulative housing defining therein a receiving cavity with two side walls aside;

a plurality of terminals disposed in the housing and extending into the receiving cavity;

a blocking tab located around an upper area of said receiving cavity, said blocking tab including a deflection portion extending along a front-to-back direction and located adjacent to one of said side walls, and a finger positioned around a free end of said deflection portion and laterally extending into an upper narrow portion of the receiving cavity; wherein said deflection portion with the associated finger is ready to be lifted up in a vertical direction to clear up said upper narrow portion, when a correct complementary plug with a substantially equal lateral dimension as the receiving cavity is inserted into the receiving cavity, for allowing said correct complementary plug to be completely received in the receiving cavity, while being not to be lifted up to clear up said upper narrow portion, when an incorrect complementary plug with a substantially smaller lateral dimension than the receiving cavity is inserted into the receiving cavity, for preventing said incorrect complementary plug from being completely inserted into the receiving cavity;

wherein a metallic outer shield encloses said housing;

wherein said blocking tab integrally extends from said shield;

wherein the metallic outer shield and the blocking tab are a one-piece construction.

* * * * *